US005235911A

United States Patent [19]

Dorfman et al.

[11] Patent Number: 5,235,911

[45] Date of Patent: Aug. 17, 1993

[54] PLATE CYLINDER REGISTRATION APPARATUS

[75] Inventors: Jan L. Dorfman, Littleton; Larry M. Dugan, Boulder; Frank L. Shriver, Lakewood, all of Colo.

[73] Assignee: Coors Brewing Company, Golden, Colo.

[21] Appl. No.: 902,923

[22] Filed: Jun. 23, 1992

Related U.S. Application Data

[63] Continuation-in-part of Ser. No. 724,735, Jul. 2, 1991, abandoned.

[51] Int. Cl.[5] ..... B41F 13/14

[52] U.S. Cl. ..... 101/248; 101/40

[58] Field of Search ..... 101/40, 248

[56] References Cited

U.S. PATENT DOCUMENTS

| | | | |
|---|---|---|---|
| 2,260,402 | 10/1941 | Potdevin | 101/248 |
| 2,425,914 | 8/1947 | Blackley et al. | 101/248 |
| 2,566,399 | 9/1951 | Bishop | 101/248 |
| 3,742,850 | 7/1973 | Sedlak | 101/248 |
| 4,741,266 | 5/1988 | Stirbis et al. | 101/40 |

*Primary Examiner*—Edgar S. Burr
*Assistant Examiner*—Stephen R. Funk
*Attorney, Agent, or Firm*—Klaas, Law, O'Meara & Malkin

[57] ABSTRACT

Registration apparatus for controlling the image height and circumferential orientation of a plate cylinder of a can decorating apparatus using hydraulic linear actuators or electric linear actuators to move first adjustors for the circumferential orientation and second adjustors for the image height orientation.

12 Claims, 8 Drawing Sheets

PLATE CYLINDER REGISTRATION APPARATUS

This application is a continuation-in-part of U.S. patent application, Ser. No. 724,735 filed Jul. 2, 1991, now abandoned, for PLATE CYLINDER REGISTRATION APPARATUS.

FIELD OF THE INVENTION

This invention relates generally to can decorating apparatus and more particularly to apparatus for adjusting the image height and circumferential registration of a plate cylinder used in such can decorating apparatus.

BACKGROUND OF THE INVENTION

There are many types of can decorating apparatus in present use. One such apparatus is illustrated and described in U.S. Pat. No. 4,741,266 issued to Stirbis et al. on May 3, 1988, which is incorporated herein by reference thereto. In the Stirbis et al. patent and in other commercial can decorating apparatus, a plate cylinder is used to transfer wet ink images from the plate cylinder to a blanket wheel segment for printing on the outer surface of a can body. In order that the wet image be properly located on the outer surface, it is desired to be able to adjust the plate cylinder in axial and circumferential directions. In FIGS. 10–15, Stirbis et al. illustrate apparatus for making these adjustments and describes such adjustments from column 7, line 1 to column 11, line 55. While the apparatus in Stirbis et al. functions to make precise adjustments of the plate cylinder in axial and circumferential directions, it is desirable to provide a more simple and at least as precise adjusting apparatus.

BRIEF DESCRIPTION OF THE INVENTION

This invention provides plate cylinder registration apparatus that uses hydraulic or electric linear actuators to make the axial and circumferential adjustments of the plate cylinder and is particularly suitable for use in a can decorating apparatus.

The plate cylinder registration apparatus of this invention is used to move the annular flange member 340 in FIGS. 10–15 of the Stirbis et al. apparatus to make the circumferential adjustments and to move the flange member 358 to make the linear axial adjustments. In one preferred embodiment of the apparatus for controlling the registration of a plate cylinder of a can decorating apparatus, at least one plate cylinder assembly is mounted on the base frame of the can decorating apparatus and has a plate cylinder mounted for rotation relative thereto. First adjusting means are provided for moving the plate cylinder in opposite circumferential directions and second adjusting means are provided for moving the plate cylinder in opposite linear axial directions. A support member is mounted on the base frame at a location close to the plate cylinder mounting. First control means are mounted for sliding movement in opposite directions over the support plate and are in contacting relationship with the first adjusting means. Second control means are mounted for sliding movement in opposite directions over the support member and are in contacting relationship with the second adjusting means. First drive means are provided for moving the first control means and second drive means are provided for moving the second control means. At least one slide guide rail is mounted at a fixed location on the support member and the first and second control means are mounted on the at least one slide guide rail at spaced apart locations so that the first and second control means can move over the at least one slide guide relative to each other. If desired, the at least one slide guide can comprise two spaced apart slide guides. Each of the first and second drive means comprises a hydraulic linear actuator.

In another preferred embodiment of the invention, at least two electric linear actuators, such as a rotary electric stepping motor rotating an acme thread lead screw which moves a thrust tube in opposite linear directions, are used for controlling the registration of the plate cylinder. A support member having opposite end portions has a mounting plate secured on each of the opposite end portions. At least one of the mounting plates has openings formed therein for securing the at least one of the mounting plates on said rigid base frame. Each of the electric linear actuators has a thrust tube and at least a main body portion. The thrust tube is mounted at a fixed location so that the main body portion moves over the thrust tube. A slide guide rail is mounted on the support and a slide bearing block is mounted for sliding movement over the slide guide rail. A support plate is mounted on each of the main body portions for movement therewith and projects upwardly therefrom. A plate member is mounted on each of the support plates for movement therewith and extending outwardly therefrom and a first portion of each of the first and second control means is mounted on one of the plate members. The plate member is mounted on the slide bearing block so that the main body portion is supported on the slide bearing block. A mounting member is adjustably mounted on each of the plate members and a second portion of each of the first and second control means is mounted on one of the mounting members.

In another preferred embodiment of the invention, the main body portions of the two electric linear actuators are mounted at fixed locations so that rotation of the lead screws causes the thrust tubes to be moved in linear directions.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
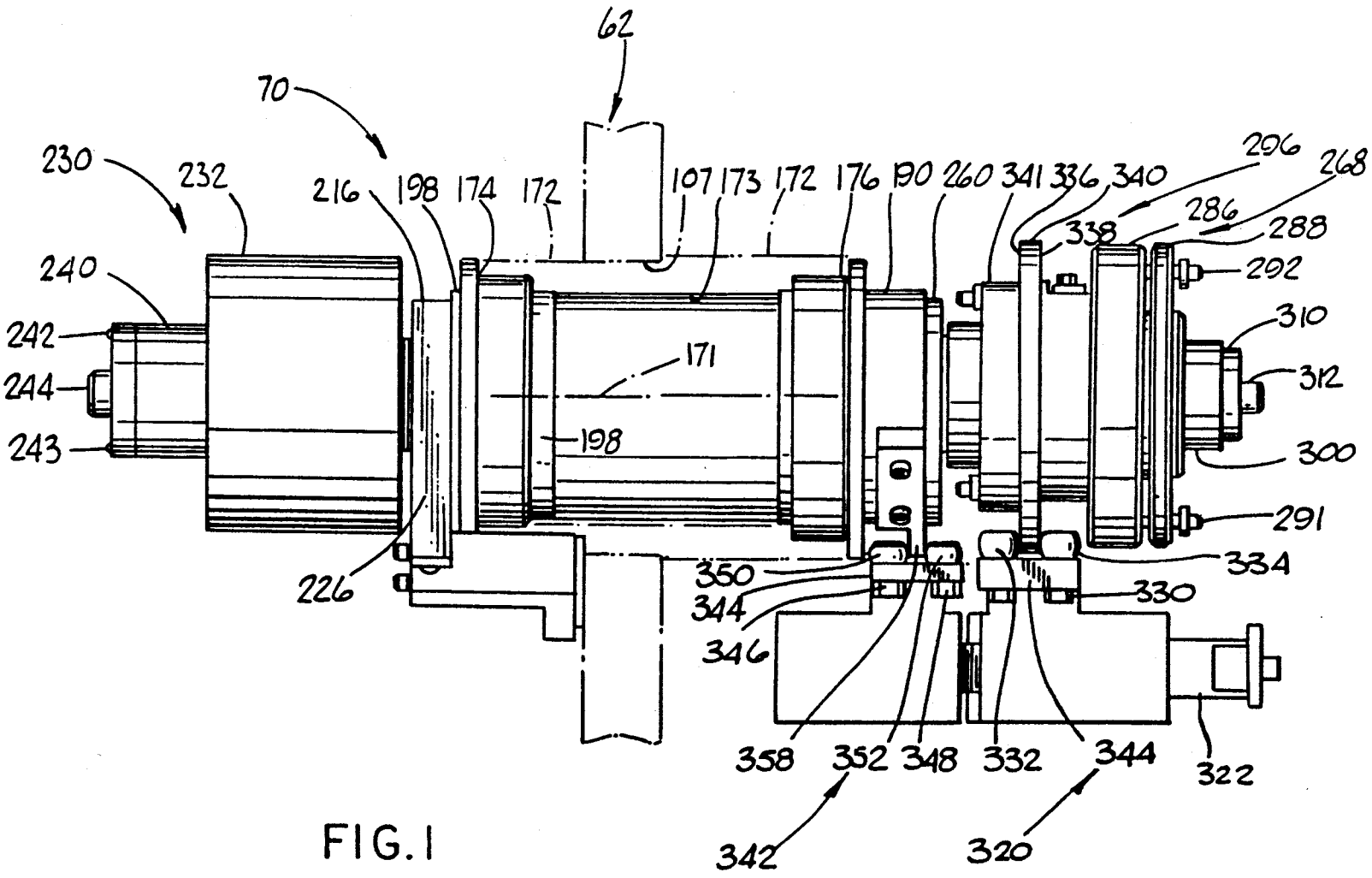
FIG. 1 is a side elevational view of a plate cylinder assembly similar to that illustrated in FIG. 10 of the Stirbis et al. patent.
Figure 10:
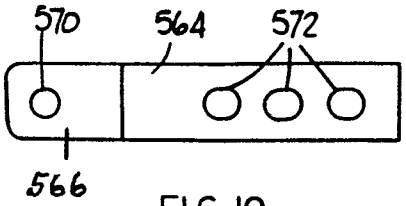
Figure 7:
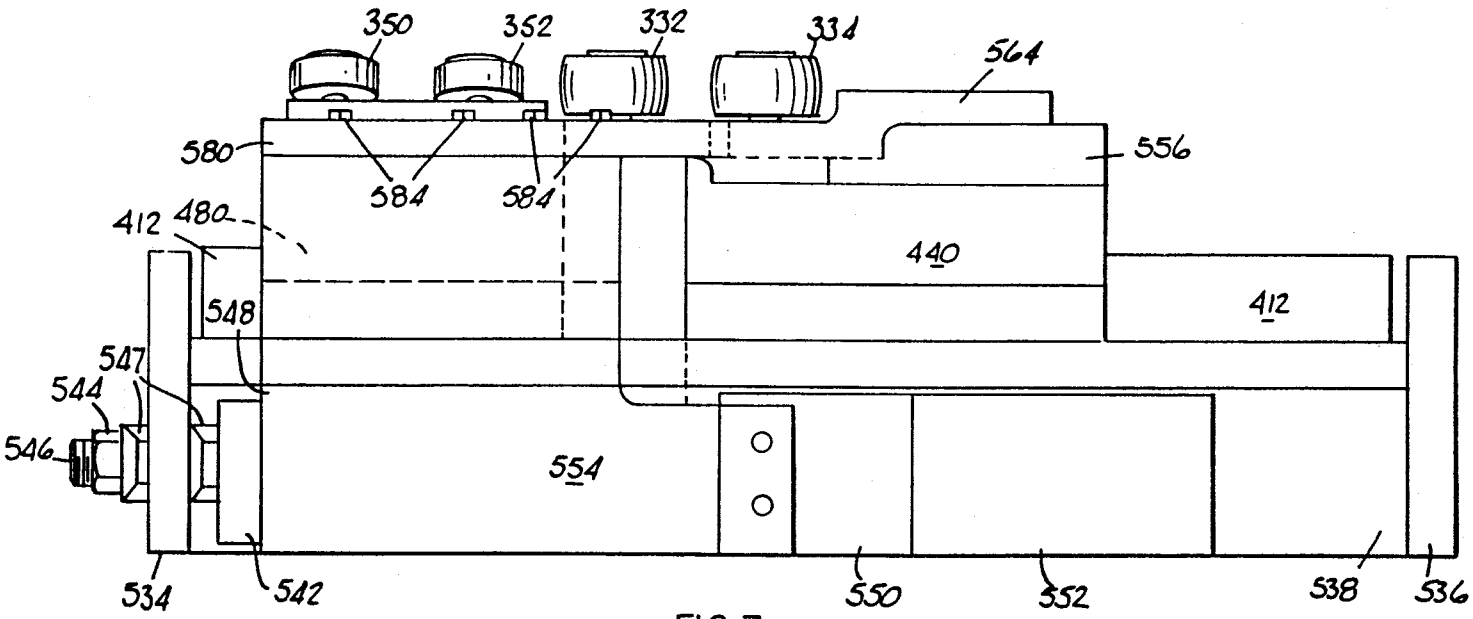
FIG. 7 is a side elevational view of FIG. 6.
Figure 11:
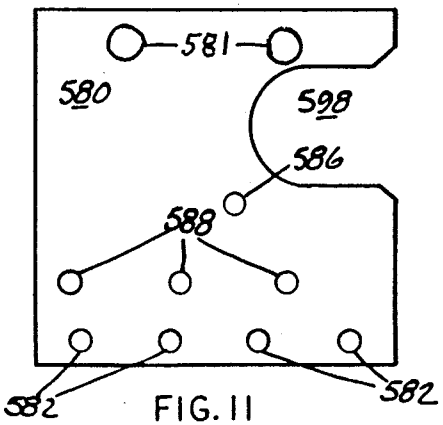

In FIG. 1, there is illustrated a plate cylinder assembly 70 mounted on the rigid plate means 62 which is similar to that illustrated in FIG. 10 of the Stirbis et al. patent. Reference numerals correspond up to 400 to those in the Stirbis et al. patent and have been used in FIGS. 1-7 to identify corresponding parts. The reference numerals commencing with 402 are used to identify the parts of this application.

Figure 2:
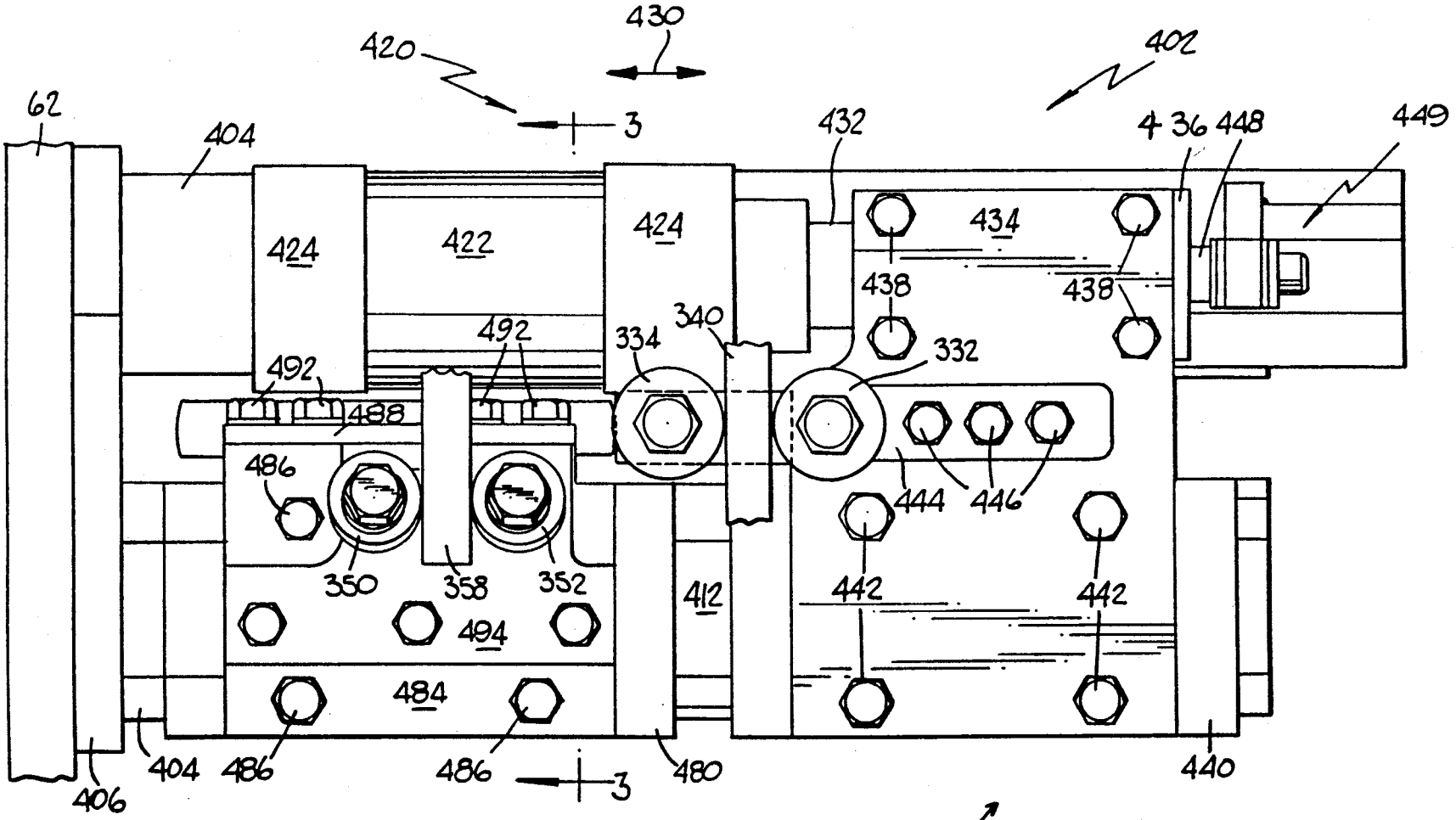
FIG. 2 is a top plan view with parts removed of one preferred embodiment of plate registration apparatus of this invention.
Figure 3:
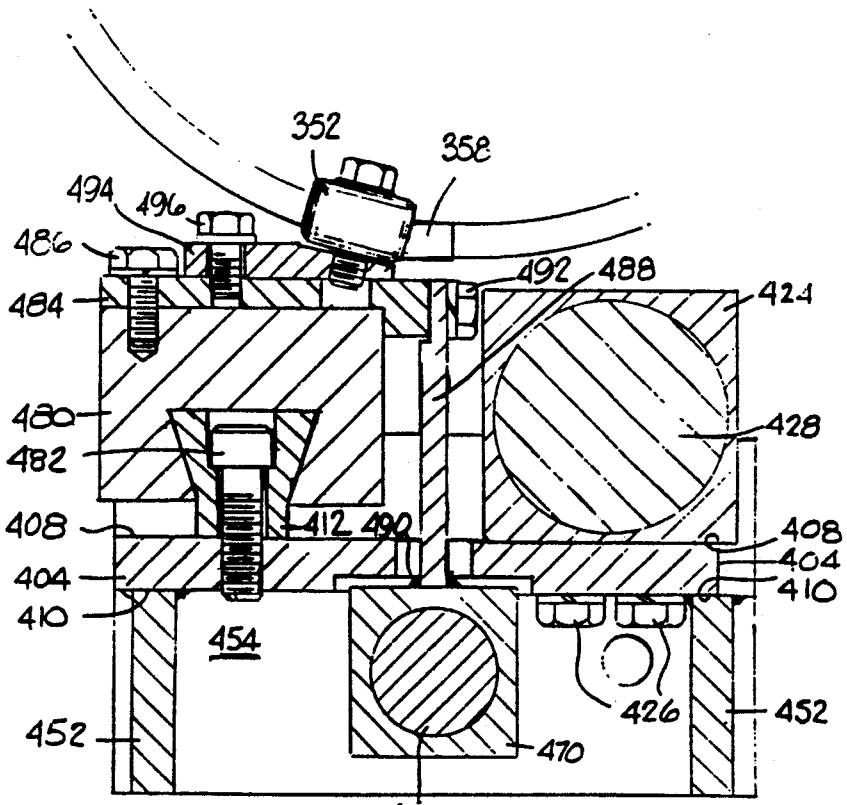
FIG. 3 is a cross-sectional view taken on the line 3—3 of FIG. 2.
Figure 4:
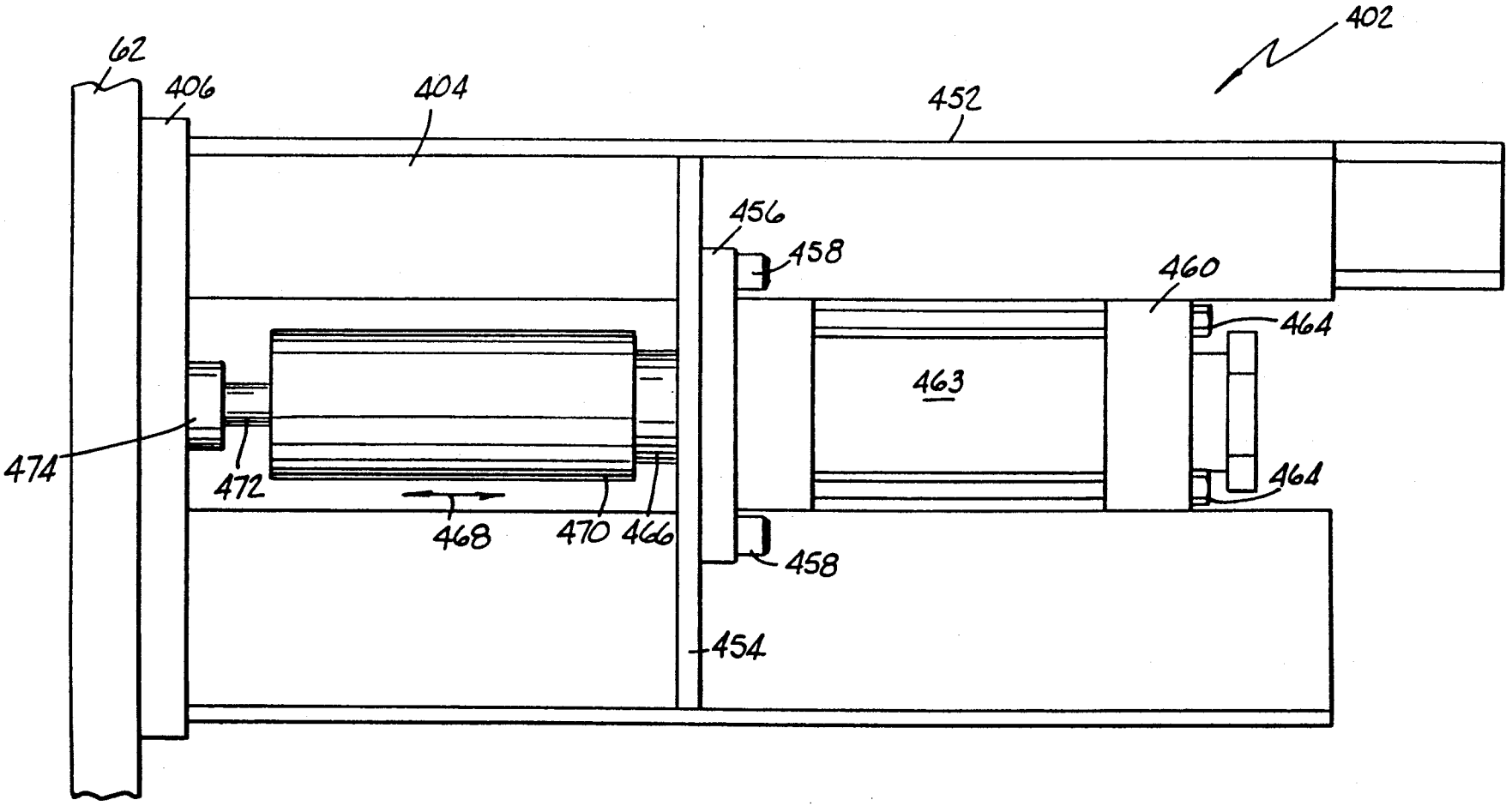
FIG. 4 is a bottom plan view of FIG. 2.
Figure 6:
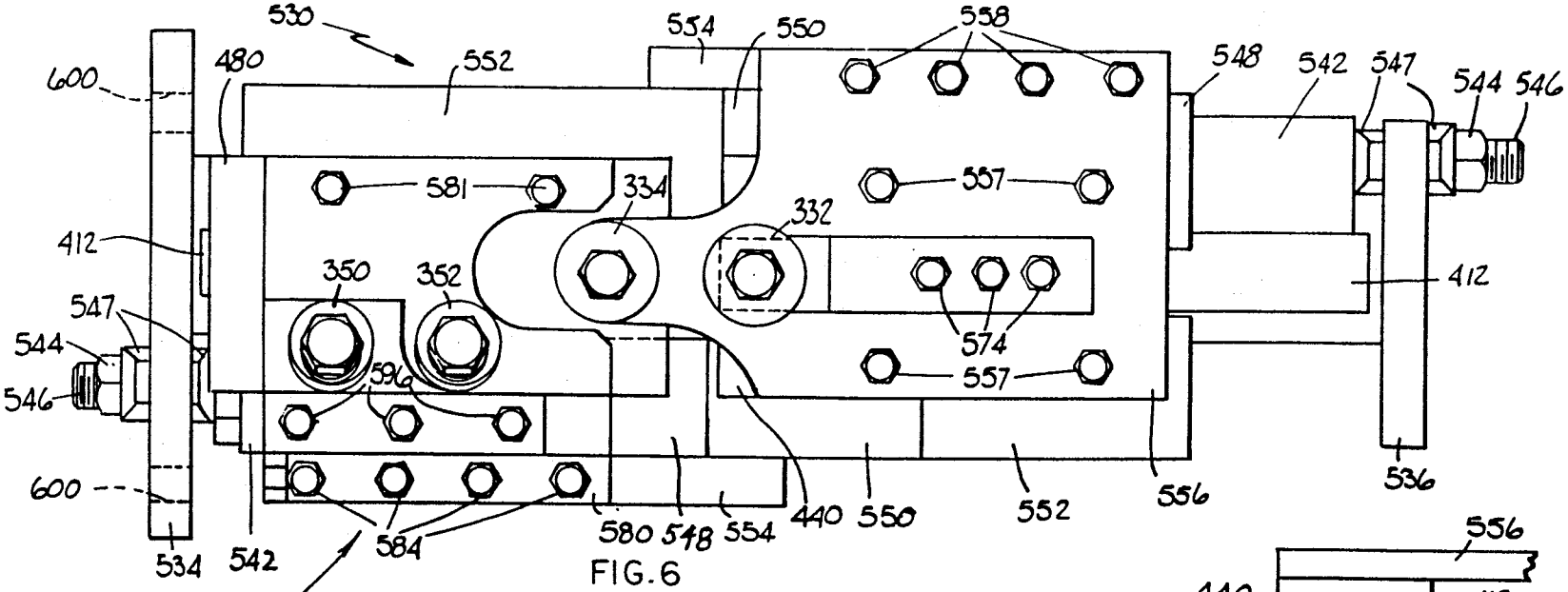
FIG. 6 is a top plan view with parts removed of another preferred embodiment of plate registration apparatus of this invention.

In FIGS. 2-4, there is illustrated one preferred embodiment of the plate cylinder registration apparatus 402 of this invention. Two support members 404 are mounted on a support bracket 406 which is fixedly secured on the rigid plate means 62 by suitable means, such as by welding (not shown). Each support member 404 has an upper surface 408 and a lower surface 410. A slide guide rail 412 is mounted at a fixed location on the support member 404 so that its longitudinal axis is parallel to the longitudinal axis of the plate cylinder member 230.

First control means 420 are provided for moving the first adjusting means 340, the annular flange in the Stirbis et al. patent, to provide for the circumferential registration of the plate cylinder member 230 as described in the Stirbis et al. patent. The first control means 420 comprise a hydraulic cylinder 422 fixedly secured in the mounting brackets 424 fixedly mounted on the support member 404 by headed threaded bolts 426. The hydraulic cylinder 422 drives a piston 428 in opposite directions as indicated by the arrow 430. The piston 428 has a piston rod 432 for movement therewith. A plate member 434 is secured to a friction brake 436, described more fully below, mounted on the piston rod 432 for movement therewith by headed threaded bolts 438 and to a slide block 440 by headed threaded bolts 442. The slide block 440 is mounted for sliding movement over the slide guide rail 412 using a conventional dovetail relationship as described below. The slide guide rail 412 and the slide bearing block 440 are of the type marketed by THK as Type SR..W and SR...V. The roller members 332 and 334, corresponding to those in the Stirbis et al. patent, are mounted on a support bracket 444 secured to the plate member 434 by headed threaded bolts 446. The roller members 332 and 334 are in contact with the first adjusting means 340 so that movement of the plate member 434 moves the first adjusting means 340.

A pin 448 is fixedly mounted in support structure 449 secured at a fixed location on support member 404. The friction brake 436 is in frictional engagement with the pin 448 and moves over the pin 448 in either of the directions indicated by the arrow 430 in response to a force applied by the piston rod 432, but functions to hold the plate member 434 at a fixed location when no force is being applied by the piston rod 432.

Second control means 450 are provided for moving the second adjusting means 358, the flange member in the Stirbis et al. patent, to provide for the image height registration of the plate cylinder member 230 as described in the Stirbis et al. patent. A depending flange member 452 is secured to each support member 404 by suitable means, such as by welding (not shown), and a transverse reinforcing member 454 extends between and is secured to the depending flange members 452 by suitable means, such as by welding (not shown). A first mounting bracket 456 is mounted on the transverse reinforcing plate 454 by headed threaded bolts 458 and cooperates with a second mounting bracket 460 to hold a hydraulic cylinder 463 in place. Headed threaded bolts 464 secure the second mounting bracket 460 to the first mounting bracket 456. A piston rod 466 extends from a piston (not shown) in the hydraulic cylinder 463 and is moved thereby in opposite directions as indicated by the arrow 468. A friction brake 470, similar to the friction brake 436, is mounted on the piston rod 466 for movement therewith. A pin 472 projects outwardly from the friction brake 470 and is secured at a fixed location on a spherical washer 474 of the type marketed by Jergens under the trade designation "Self-Aligning Washers" secured to support bracket 406. The friction brake 470 moves over the pin 472 in either of the directions indicated by the arrow 468 in response to a force applied by the piston rod 466 but functions to hold the friction brake 470 at a fixed location when no force is being applied by the piston rod 466.

As illustrated in FIG. 3, a slide bearing block 480 is mounted for sliding movement over another portion of the slide guide rail 412 which is secured at a fixed location on the support member 404 by a plurality of headed threaded bolts 482. A dovetail arrangement, as illustrated in FIG. 1, is used to connect the slide bearing block 480 and the slide bearing block 440 on the slide guide rail 412. A plate member 484 is mounted on the slide bearing block 480 by a plurality of headed threaded bolts 486. A connecting member 488 is secured to the friction brake 470 by welding 490 and to the plate member 484 by a plurality of headed threaded bolts 492 so that connecting member 488 moves with the friction brake 470 to move the plate member 484. A support bracket 494 is mounted on the plate member 484 by a plurality of headed threaded bolts 496. The roller members 350 and 352, corresponding to those in the Stirbis et al. patent, are mounted on the support bracket 494 so as to be in contacting relationship with the second adjusting means 358, the flange member in the Stirbis et al. patent, so that movement of the roller members 350 and 352 moves the second adjusting means 358 to provide for the linear axial adjustment of the plate cylinder member 230 as described in the Stirbis et al. patent.

Figure 5:
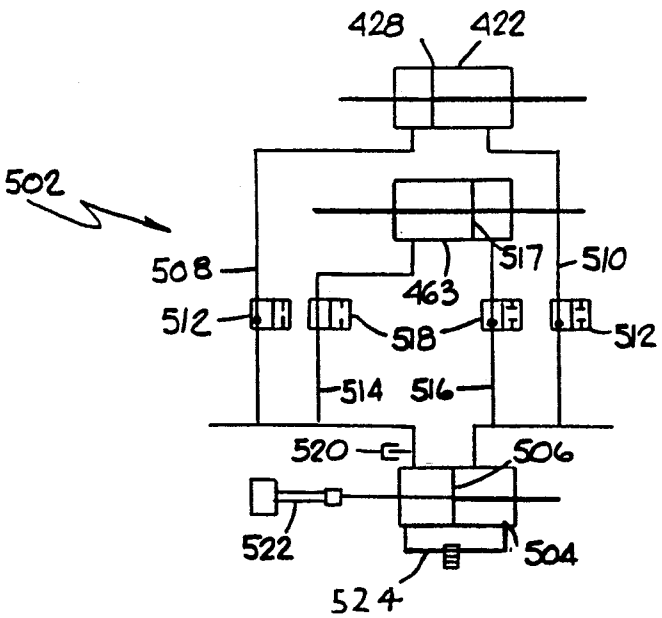
FIG. 5 is a schematic illustration of a hydraulic control system in combination with a linear actuator for this invention.

A control system 502 for operating the hydraulic cylinders 422 and 463 is schematically illustrated in FIG. 5. A main hydraulic cylinder 504 is mounted at a fixed location and has a piston 506 for moving hydraulic fluid out of and into the main hydraulic cylinder 504. Hydraulic fluid supply lines 508 and 510 extend between the main hydraulic cylinder 504 and the hydraulic cylinder 422. Each hydraulic fluid supply line 508 and 510 has valve means 512 for permitting or not permitting flow of hydraulic fluid therethrough. Hydraulic fluid supply lines 514 and 516 extend between the main hydraulic cylinder 504 and the hydraulic cylinder 463 having a piston 517. Each hydraulic fluid supply line 514 and 516 has valve means 518 for permitting or not permitting flow of hydraulic fluid therethrough. The system is a closed system with all units being filled with hydraulic fluid. A conventional hydraulic fluid supply means 520 is provided to insure that the control system 502 is filled with hydraulic fluid. A conventional linear actuator 522 is moved to control the movement of the hydraulic fluid. A by-pass system 524 is provided to ensure that hydraulic fluid is on each side of the piston 506. When it is desired to move piston 428, valves 512 are opened and valves 518 are closed. The linear actuator 522 moves the piston 506 in a desired direction and amount to force hydraulic fluid through the hydraulic fluid supply lines 508 and 510 to move the piston 428 in the desired direction and in the desired amount. When it is desired to move piston 517, valves 512 are closed and valves 518 are opened. The linear actuator 522 moves the piston 506 in a desired direction and amount to force hydraulic fluid through the hydraulic fluid supply lines 514 and 516 to move the piston 517 in the desired direction and in the desired amount. All of the hydraulic cylinders have double ended rods to ensure equal area on each side of the pistons.

Figure 8:
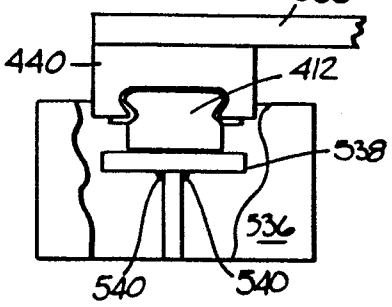
FIG. 8 is an end elevational view of the mounting means.
Figure 9:
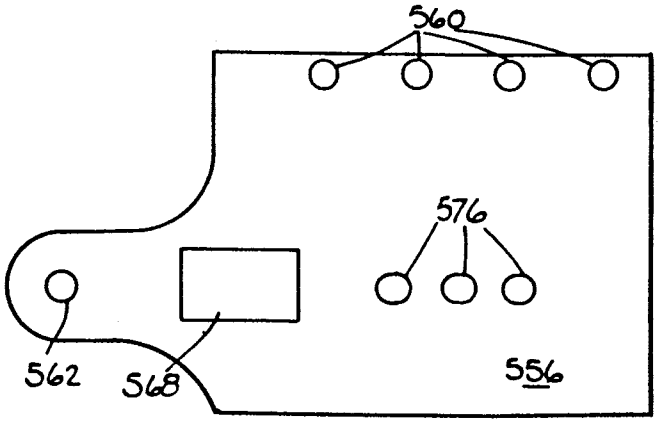
FIGS. 9–12 are top plan views of various portions of FIG. 6.

In FIGS. 6–12, electric linear actuators 530 and 532 are used to adjust the roller members 332 and 334 and 350 and 352. Each electric linear actuator is of the type marketed by Industrial Devices Corporation under the trade designation Electric Linear Actuator. Each electric linear actuator is a rotary electromagnetic stepping motor which rotates a lead screw causing a drive nut to translate extending or retracting a thrust tube. Mounting plates 534 and 536, FIG. 8, are secured to each end of a T-shaped support beam 538 by suitable means, such as the welds 540. The thrust tube 542 of the electric linear actuator 530 is mounted on the mounting plate 536 by lock nuts 544 on a threaded stud 546. A conventional spherical washer set 547 is located on the threaded stud 546 on each side of the mounting plate 536. The main body portion 548 of the electric linear actuator 530, including the gear box 550 and the motor 552, is mounted for sliding movement over the thrust tube 542. Since the thrust tube 542 is fixedly mounted on the mounting plate 536 movement of the lead screw moves the main body portion 548 over the thrust tube 542. A support plate 554 is mounted on the main body portion 548. A plate member 556, FIG. 9, is mounted on the support plate 554 using headed threaded bolts 558 passing through openings 560 and secured in threaded holes (not shown) in the support plate 554. A threaded opening 562 is provided for mounting the roller member 334. A mounting member 564, FIG. 10, has a lower portion 566 which fits in an opening 568 in the plate member 556. The opening 568 is larger than the lower portion 566 so that the lower portion 566 has limited movement therein. A threaded opening 570 is provided for mounting the roller member 332. The mounting member 564 has three oval shaped openings 572 formed therein. Headed threaded bolts 574 pass through the oval openings 572 and are threaded into threaded openings 576 in the plate member 556. This provides for the adjustable mounting of the roller member 332. The plate member 556 is mounted on a slide bearing block 440 using headed threaded bolts 557 for movement over the slide guide rail 412 mounted on the T-shaped support member 538, FIG. 8.

Figure 12:
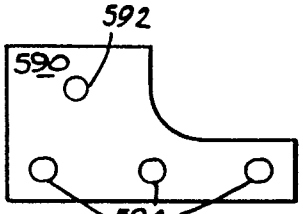

The electric linear actuator 532 is mounted on the mounting plate 534 in the same manner as the electric linear actuator 530 and the corresponding parts have been given the corresponding reference numbers. A plate member 580, FIG. 11, shaped differently than the plate member 556, is provided with a plurality of holes 582 and headed threaded bolts 584 pass through the holes 582 and are threaded into threaded openings (not shown) in the support plate 554 to mount the plate member 580 on the support plate 554. A threaded opening 586 is provided in the plate member 580 for the mounting of the roller member 352. The plate member 580 is provided with a plurality of threaded openings 588. A mounting member 590, FIG. 12, is provided and has a threaded opening 592 for the mounting of the roller member 350. The mounting member 590 has a plurality of oval shaped openings 594 so that headed threaded bolts 596 may pass through the oval shaped openings 594 and be threaded into the threaded openings 588. This provides for the adjustable mounting of the roller member 350. The plate member 580 has a cut out portion 598 to provide for the movement of the roller members 332 and 334. The plate member 580 is mounted on the slide bearing block 480 using headed threaded bolts 581 for movement over the slide guide rail 412 mounted on top of the support member 538. Threaded mounting holes 600 are formed in the mounting plate 534 for mounting on the base frame 62.

In operation, the electric linear actuator 530 is moved to move the roller members 332 and 334 and the electric linear actuator 532 is moved to move the roller members 350 and 352.

Figure 13:
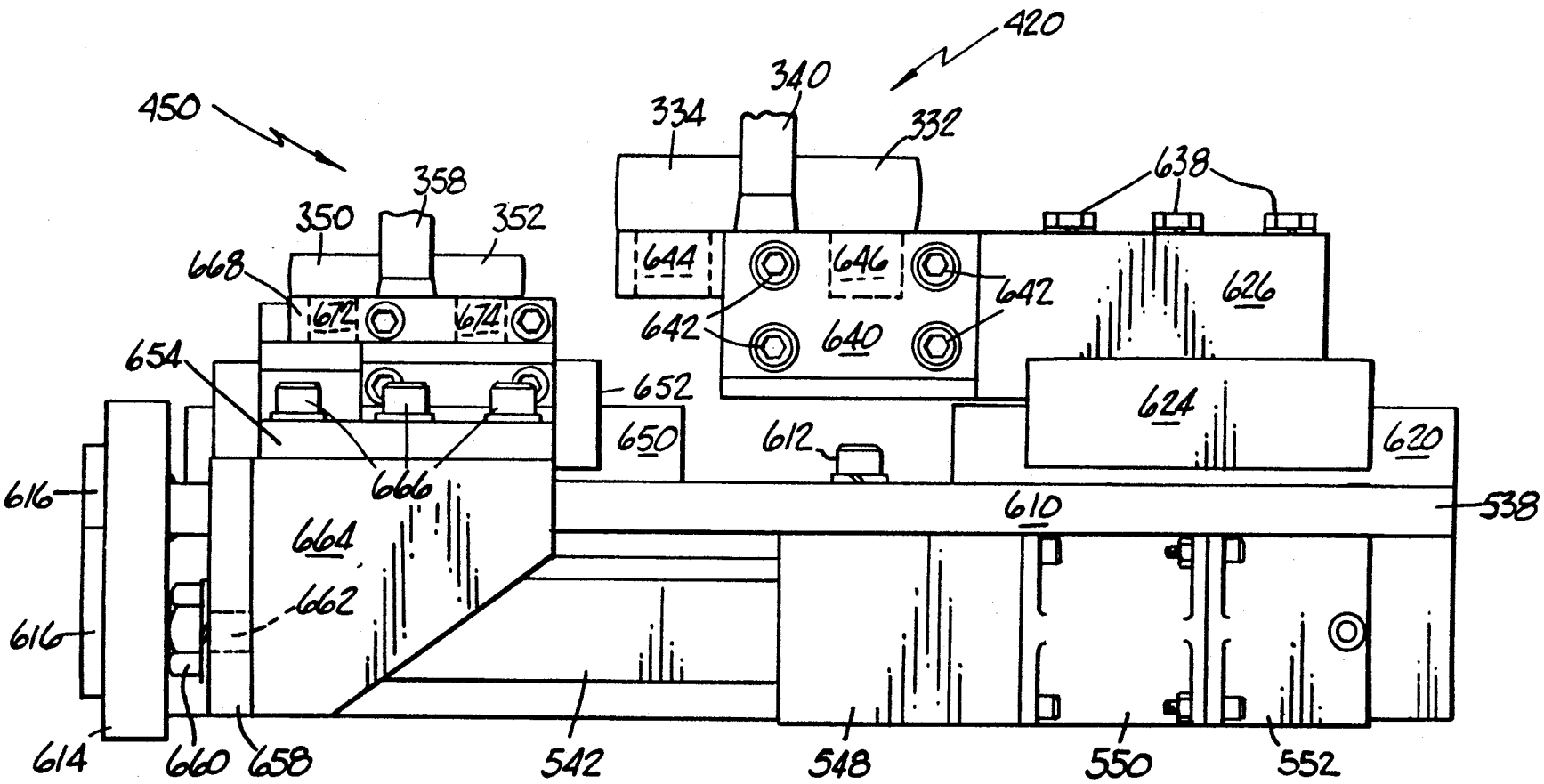
FIG. 13 is a generally schematic side elevational view of another embodiment of the invention.
Figure 14:
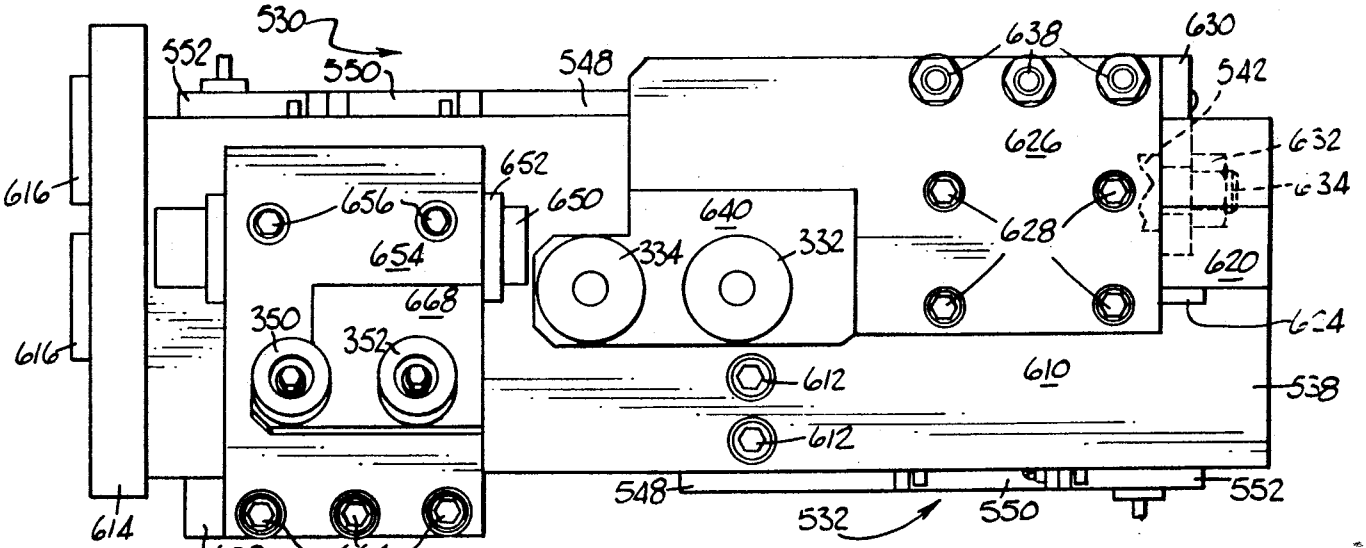
FIG. 14 is a top plan view of FIG. 13.
Figure 15:
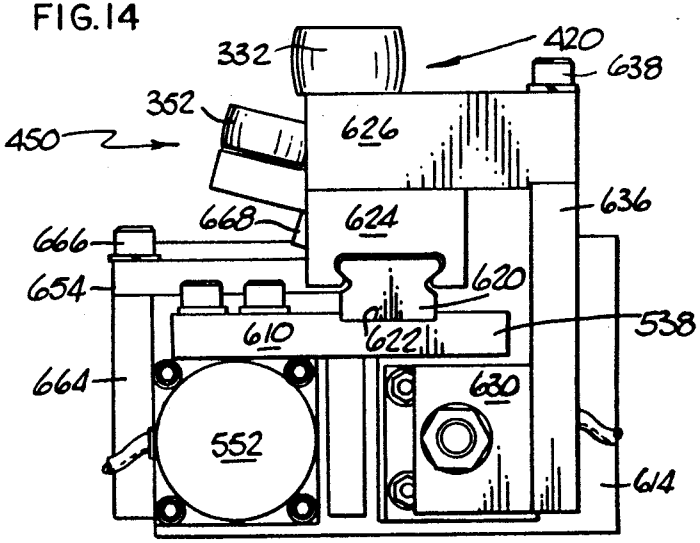
FIG. 15 is an end elevational view taken from the right side of FIG. 13.

Another preferred embodiment of the invention is illustrated in FIGS. 13–15 in which parts previously identified have been given the same reference numerals. The main body portions 548 of the electric linear actuators 530 and 532 are secured to the horizontal portion 610 of the T-shaped support beam 538 by headed threaded bolts 612 passing through openings (not shown) in the horizontal portion 610 and secured in threaded openings (not shown) in the main body portions 548 so that the main body portions are secured at a fixed location. The headed threaded bolts 612 for the electric linear actuator 530 are not shown. The support beam 538 is secured to a mounting plate 614 which has a pair of spaced apart bosses 616 which are mounted in openings (not shown) in the rigid plate means 62.

The linear movement of the thrust tube 542 of the electric linear actuator 530 is guided by support means which include a first guide rail 620 which is mounted in a recess 622 in the horizontal portion 610 by suitable means, such as threaded bolts (not shown). A first slide bearing block 624 is mounted for sliding movement over the first guide rail 620. A first mounting block 626 is secured to the first slide bearing block 626 using headed threaded bolts 628 passing through openings (not shown) in the first mounting block 624 and secured in threaded openings (not shown) in the first slide bearing block 624. A first support plate 630 is secured to the thrust tube 542 using a threaded nut 632 in threaded engagement with a threaded stud 634 extending outwardly from the thrust tube 542 and bearing against the first support plate 630. A first extension member 636 is secured to the first support plate 630 by suitable means, such as by welding (not shown) and projects therefrom at an angle of 90 degrees. The first extension member 636 is secured to the first mounting block 626 using headed threaded bolts 638 passing through openings (not shown) in the first mounting block 626 and secured in threaded openings (not shown) in the first extension member 636. A first support member 640 is secured in a recess in the first mounting block 626 using headed threaded bolts 642 passing through openings (not shown) in the first support member 640 and secured in threaded openings (not shown) in the first mounting block 626. The roller member 334 is mounted at a fixed location on the first support member 640 by first mounting means 644. The roller member 332 is adjustably mounted on the first support member 640 using first rotary eccentric mounting means 646 so that the roller member 332 may be adjusted to vary the distance between the roller members 334 and 332 to ensure firm contact with the first adjusting means 340.

The linear movement of the thrust tube 542 of the electric linear actuator 532 is guided by support means which include a second guide rail 650 which is mounted in a recess, similar to the recess 622 in the horizontal portion 610 by suitable means, such as threaded bolts (not shown). A second slide bearing block 652 is mounted for sliding movement over the second guide rail 650. A second mounting block 654 is secured to the second slide bearing block 652 using headed threaded bolts 656 passing through openings (not shown) in the second mounting block 654 and secured in threaded openings (not shown) in the second slide bearing block 652. A second support plate 658 is secured to the thrust tube 542 using a threaded nut 660 in threaded engagement with a threaded stud 662 extending outwardly from the thrust tube 542 and bearing against the second support plate 658. A second extension member 664 is secured to the second support plate 658 by suitable means, such as by welding (not shown) and projects therefrom at an angle of 90 degrees. The second extension member 664 is secured to the second mounting block 655 using headed threaded bolts 666 passing through openings (not shown) in the second mounting block 654 and secured in threaded openings (not shown) in the second extension member 664. A second support member 668 is secured in a recess in the second mounting block 654 using headed threaded bolts 670 passing through openings (not shown) in the second support member 668 and secured in threaded openings (not shown) in the second mounting block 654. The roller member 350 is mounted at a fixed location on the second support member 668 by second mounting means 672. The roller member 352 is adjustably mounted on the second support member 668 using second rotary eccentric mounting means 674 so that the roller member 352 may be adjusted to vary the distance between the roller members 350 and 352 to ensure firm contact with the second adjusting means 358.

Movement of the thrust tube 542 of the first linear actuator 530 functions to move roller members 332 and 334 to adjust the first adjusting means 340 and movement of the thrust tube 542 of the second linear actuator 532 functions to move the roller members 350 and 352 to adjust the second adjusting means 358.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. Apparatus for controlling the registration of a plate cylinder of a can decorating machine comprising:

a rigid base frame mounted at a fixed location;

at least one plate cylinder assembly mounted on said base frame and a plate cylinder mounted for rotation relative to said base frame;

first adjusting means for moving said plate cylinder in opposite circumferential directions;

second adjusting means for moving said plate cylinder in opposite linear direction;

a support member mounted on said base frame at a fixed location;

first control means mounted for linear movement in opposite directions over said support member, said first control means being in contacting relationship with said first adjusting means;

second control means mounted for linear movement in opposite directions over said support member, said second control means being in contacting relationship with said second adjusting means;

first hydraulic moving means for moving said first control means;

second hydraulic moving means for moving said second control means;

each of said first and second hydraulic moving means comprising:

a hydraulic cylinder mounted at a fixed location;

a piston rod mounted on said hydraulic cylinder for linear movement relative thereto to a desired location;

connecting means for connecting one of said first and second control means to said piston rod for movement therewith; and brake means, mounted on said piston rod for movement therewith, for releasably holding said piston rod at said desired location.

2. The invention as in claim 1 and further comprising:

at least one slide guide fixedly mounted on said support member; and first and second mounting means for mounting said first and second control means on said at least one slide guide at spaced apart locations so that said first and second control means can move over said at least one slide guide relative to each other.

3. The invention as in claim 2 wherein said first mounting means comprise:

a mounting plate having first and second opposite end portions;

attaching means for attaching said first end portion to a portion of said brake means;

a slide block mounted on said second end portion and on said slide guide for movement thereover.

4. The invention as in claim 1 wherein said brake means comprise:

a pin mounted at a fixed location; and a friction brake mounted on said pin for movement thereover, said friction brake being in frictional contact with said pin to releasably hold said piston rod at said desired location.

5. Apparatus for controlling the registration of a plate cylinder of a can decorating machine comprising:

a rigid base frame mounted at a fixed location;

at least one plate cylinder assembly mounted on said base frame and a plate cylinder mounted for rotation relative to said base frame;

first adjusting means for moving said plate cylinder in opposite circumferential directions;

second adjusting means for moving said plate cylinder in opposite linear directions;

a support member mounted on said base frame at a fixed location;

first control means mounted for linear movement in opposite directions over said support member, said first control means being in contacting relationship with said first adjusting means;

second control means mounted for linear movement in opposite directions over said support member, said second control means being in contacting relationship with said second adjusting means;

first electric linear actuating means for moving said first control means;

second electric linear actuating means for moving said second control means;

first and second mounting means for mounting each of said electric linear actuating means on said rigid base frame;

said first mounting means comprising:

a support beam having opposite end portions;

a mounting plate secured on each of said opposite end portions;

at least one slide guide rail mounted on said support beam;

at least one of said mounting plates having openings formed therein for securing said at least one of said mounting plates on said rigid base frame;

each of said electric linear actuating means having a thrust tube and at least a main body portion for relative linear movement therebetween;

first mounting means for mounting said thrust tube of one of said electric linear actuating means at a fixed location on one of said mounting plates;

second mounting means for mounting said thrust tube of the other of said electric linear actuators at a fixed location on the other of said mounting plates;

support means for supporting each of said main body portions and connected thereto for movement therewith; and said support means mounted for sliding movement over said slide guide rail.

6. The invention as in claim 5 wherein said support means comprises:

a first slide bearing block mounted for movement over said slide guide rail and on which said main body portion of said one of said electric linear actuators is mounted; and a second slide bearing block mounted for movement over said slide guide rail and on which said main body portion of said other of said linear actuators is mounted for permitting relative movement between the first and second slide bearing blocks.

7. The invention as in claim 6 and further comprising:

a support plate mounted on each of said main body portions for movement therewith and projecting upwardly therefrom;

one of said support plates mounted on each of said first and second slide bearing blocks;

a plate member mounted on each of said support plates for movement therewith and extending outwardly therefrom;

a first portion of each of said first and second control means mounted on one of said plate members;

mounting means adjustably mounted on each of said plate members; and a second portion of each of said first and second control means mounted on one of said mounting means.

8. The invention as in claim 5 wherein said second mounting means for mounting each of said electric linear actuating means comprises:

a support beam mounted on said rigid base frame and having a generally planar upper surface;

at least one slide guide rail mounted on said generally planar upper surface;

each of said electric linear actuating means having a main body portion and a thrust tube having linear movement relative thereto;

first mounting means for mounting said main body portion of one of said electric linear actuating means at a fixed location on said support beam;

second mounting means for mounting said main body portion of the other of said electric linear actuating means at a different fixed location on said support beam; and support means for supporting each of said thrust tubes for sliding movement over said at least one slide guide rail.

9. The invention as in claim 8 wherein said at least one slide guide rail comprises:

at least a pair of spaced apart slide guide rails.

10. The invention as in claim 9 wherein said support means comprise:

a first slide bearing block mounted for movement over one of said pair of spaced apart slide guide rails and to which one of said thrust tubes is mounted; and a second slide bearing block mounted for movement over the other of said pair of spaced apart slide guide rails and to which the other of said thrust tubes is mounted.

11. The invention as in claim 10 and further comprising:

a support plate mounted on each of said thrust tubes for movement therewith and projecting upwardly therefrom;

a first mounting block secured on said first slide bearing block for movement therewith;

first connecting means for connecting said first mounting block to one of said support plates for movement therewith;

a first support member secured to said first mounting block;

said first control means mounted on said first support member;

a second mounting block secured on said second slide bearing block for movement therewith;

second connecting means for connecting said second mounting block to the other of said support plates for movement therewith;

a second support member secured to said second mounting block; and said second control means mounted on said second support member.

12. The invention as in claim 11 wherein each of said first and second control means comprises:

a first contact member having an outer surface for line contact with a portion of one of said first and second adjusting means;

a second contact member spaced a distance from said first contacting member and having an outer surface for line contact with another portion of one of said first and second adjusting means; and adjusting means for adjusting the distance between said outer surfaces of said first and second contact members.

* * * * *